US005926099A

United States Patent [19]

Unum

[11] Patent Number: 5,926,099

[45] Date of Patent: Jul. 20, 1999

[54] ELECTRONIC TOILET LID POSITION SIGNAL

[76] Inventor: Ana Laina Pedersen Unum, 6138 Pioneer Park, Langley, Wash. 98260-9728

[21] Appl. No.: 08/986,599

[22] Filed: Dec. 8, 1997

[51] Int. Cl.[6] ..... G08B 21/00

[52] U.S. Cl. ..... 340/686.1; 340/689; 4/661; 200/61.52

[58] Field of Search ..... 340/686.1, 573, 340/689, 687; 4/661; 200/61.52, 61.45 R, 61.62

[56] References Cited

U.S. PATENT DOCUMENTS

| | | | |
|---|---|---|---|
| 4,733,419 | 3/1988 | Nee | 340/686 |
| 4,849,742 | 7/1989 | Warrington | 340/686 |
| 4,884,067 | 11/1989 | Nordholm et al. | 340/686 |
| 5,276,595 | 1/1994 | Patrie | 4/661 |
| 5,465,422 | 11/1995 | Dean | 4/661 |
| 5,594,423 | 1/1997 | East | 340/686 |
| 5,664,867 | 9/1997 | Martin et al. | 4/661 |
| 5,691,705 | 11/1997 | East | 340/686 |
| 5,703,567 | 12/1997 | Cleveland | 340/573 |
| 5,748,096 | 5/1998 | Kaufer | 340/686 |
| 5,767,467 | 6/1998 | Grant | 340/689 |

*Primary Examiner*—Nina Tong

[57] ABSTRACT

An electronic position signal device (10) that, when attached to a toilet lid (80), provides an audible and/or visual signal to indicate that toilet lid (80) is in an upright position. Position signal device (10) comprises a battery-powered electronic signaling module (20) with a transducer (30) for generating audible and/or visual signals similar to those used in greeting cards, and a position-sensitive switch (40). When position signal device (10) is used as a toilet lid position signal, position-sensitive switch (40) is a gravity-actuated switch which is closed (44) when the toilet lid position signal is in an upright or vertical position and open (42) when the toilet lid position signal is in a horizontal position. Closure of switch (40) activates signaling module (20) thereby causing transducer (30) to generate an audible and/or visual signal. Three gravity-actuated versions of switch (40) are described for bridging a gap between contacts (26A and 26B) which commonly are part of signaling module (20). In one version, a weighted flexible, electrically-conductive cantilevered spring bridges gap. In the second version, a suspended freely-swinging electrically-conductive mass bridges gap. In the third version, a loose electrically-conductive object bridges gap.

1 Claim, 4 Drawing Sheets

ELECTRONIC TOILET LID POSITION SIGNAL

BACKGROUND

1. Technical Field of the Invention

The electronic position signal device comprises a position-sensitive electrical switch, a self-powered electronic signaling module with a transducer, whereby an audible and/or visible signal is given to indicate that an object to which said switch is attached is in a prescribed position.

The electronic position signal device is embodied in an electronic toilet lid position signal in which a gravity-actuated switch activates the electronic signaling module causing the transducer to produce an audible and/or visible signal to indicate that a toilet lid to which it is attached is in the raised or open position.

2. Description of the Prior Art

Toilet lids are generally made of a rigid material comprising a hinged seat, a hinged cover, or both, of which the seat, if not also the cover, should be lowered to the closed position following use. For the purposes of this patent, the seat and/or cover will be referred to as a toilet lid.

Toilet lids are often left in the open position through carelessness or inadvertence.

Most toilets and lids are not manufactured with a signal to notify users that the lid is up and should be returned to the down position.

As this is thought to be an irritating common social problem, inventor has learned through studying the technical literature that this situation can lead to severe personal trauma for subsequent users who fail to notice the upright position of the lid.

Efforts have been made to generate an audible or visible signal when a toilet lid is in the open position for teaching and reminding toilet users of the etiquette of returning the lid to its lowered position after use and to alert subsequent users of the situation.

Additionally, toilet lids, devices, and accessories have been designed to provide features for the comfort and entertainment of the user including vibrating toilet seats, seat pressure activated audio systems, viewing devices, and lighting devices.

Furthermore, toilet devices have been designed to provide features for the training and encouragement of the user, particularly small children and persons with disabilities.

Furthermore, toilet accessories and devices have been designed to provide features for the signaling of lid position for infant and pet safety.

As attempts to address these situations have been made, they have had, and still have significant problems, some of which are:

U.S. Pat. No. 4,849,742 Warrington, Jul. 18, 1989 Toilet Seat Cover Position Alarm requires a toilet tank and toilet cover, insertion of batteries, and utilizes timers, multiple switches including a mercury switch, specialized housing, and adjustments for installation and operation. Additionally, the signaling device is not activated as soon as the cover is raised, and may be deactivated before the cover is lowered.

U.S. Pat. No. 5,465,422 Dean, Nov. 7, 1995 Seat Apparatus For Actuating An Audio Source plays an audible signal when anyone sits on the toilet seat, requiring installation of a specially manufactured toilet seat and cover, insertion of batteries, multiple switches, and adjustments for installation and operation. Additionally, the signaling device is not activated as soon as the seat is raised, and may be deactivated before the seat is lowered.

U.S. Pat. No. 4,733,419 Nee, May 29, 1988 Toilet Seat-up Indicator flashes a "seat up" sign and requires a mercury switch, insertion of batteries, specialized housing with multiple compartments with specific shapes and adjustments for installation and operation. Also, by design, it is limited to functioning with the toilet seat and not the cover.

U.S. Pat. No. 4,884,067 Nordholm, et al, Nov. 28, 1989 Motion and Position Sensing Alarm with a ball in a truncated cone has a position sensing device that is activated in a horizontal position and is deactivated in a vertical position, but unfortunately has additional switches, requires an external power source, and extensive modification for application to a toilet lid.

U.S. Pat. No. 5,276,595 Patrie, Jan. 4, 1994 Color-coded Toilet Light Assembly requires body heat and position sensors, specialty housing, multiple switches, color coded lights, and by design is limited to functioning with the toilet cover and not the seat.

As constructed, these devices are subject to problems that create inconvenience or discomfort to users which discourages use. Among these problems are:

a. These and many prior solutions suggest signal devices that require the toilet have plumbing, flushing mechanisms, toilet tanks, a toilet bowl, or that the hinged lid be, specifically, a seat or a cover.

b. Prior solutions suggest signal devices that require the toilet to be in proximity to an external power source.

c. Prior solutions suggest signal devices that require the use of tools, special equipment, or special skills for their manufacture and/or installation.

d. Some prior solutions require the utilization of external mechanical attachments such as handles, pedals, or elements manufactured into or onto the toilet or its lid to facilitate operation of the signal.

e. Prior solutions suggest the use of timers. However, expiration of a fixed timer does not necessarily mean that the person will not close the toilet seat or cover before departing and requires more steps in manufacture at additional cost to the consumer.

f. Prior solutions suggest signal devices that produce unpleasant shrill beeps, buzzes, and flashing lights that discourage their use.

g. Prior solutions suggest signal devices that do not provide options of a varied selection of entertaining audible and/or visual signals thereby discouraging their use by being an irritant to the user of a toilet while the lid is raised.

h. Prior solutions suggest signal devices that are not inexpensive, disposable in nature, easy to install, replace, or remove therefore discouraging their use.

i. Prior solutions suggest signal devices that are not capable of being easily produced in a variety of shapes, or displaying a variety of indicia, therefore discouraging their use.

j. Prior solutions suggest signal devices that utilize specialized electrical circuits which require more steps in manufacture at additional cost to the consumer.

k. Prior solutions suggest signal devices that require specialized housings which require more steps in manufacture at additional cost to the consumer.

l. Many prior solutions suggest signal devices that require the handling of multiple components for their installation.

The present invention is directed to overcoming one or more of the problems discussed above.

SUMMARY

ELECTRONIC TOILET LID POSITION SIGNAL

An electronic position signal device is embodied in a toilet lid position signal.

The toilet lid position signal relates to toilet lids and to the provision of an audible and/or visible indication that a toilet lid is in an upright or vertical position.

In many situations, embarrassment or severe personal trauma has resulted from the failure to observe whether the toilet lid is in the upright or the down position.

The toilet lid position signal is a solution to that problem in that it provides a battery-powered electronic signaling module with a gravity-actuated switch assembled in a lightweight package which can be affixed directly to the underside of the lid. Said gravity-actuated switch activates the signal when the lid is up and deactivates the signal when the lid is down.

The major elements of the toilet lid position signal are a position-sensitive switch, a self-powered electronic signaling module with a transducer, and lid attachment means.

The toilet lid position signal has the practical effect of conditioning persons who use the toilet to lower the toilet seat or cover after use. The signaling means alerts a user of the toilet if the lid is upright.

The toilet lid position signal has the practical effect as a training device to encourage persons, particularly small children, to use the toilet and to routinely lower the toilet seat or cover.

The toilet lid position signal has the practical effect, as an audible signaling device, to alert others that another, particularly a small child or infant, has raised the seat or cover or needs to use the toilet.

The toilet lid position signal is designed to add a dimension of comfort and relaxation to toilets in a manner not previously known by providing for a toilet lid position signaling accessory which includes an electronic audio and/or light module that is activated when a person raises the toilet lid, and is deactivated when the lid is lowered.

Objects and Advantages

Accordingly, several objects and advantages of the toilet lid position signal are an electronic toilet lid position signaling accessory which includes an electronic audio and/or light module and:

a. is activated when a person raises the toilet lid, and is deactivated when the lid is lowered;

b. is self-contained and can be of a size that can be utilized with any toilet comprising a hinged lid of the common type covering a void, said lid being capable of being moved from between a vertical position and a horizontal position;

c. utilizes a low cost, commonly made electronic signaling module providing a wide variety of options of entertaining melodies and/or other audible signals, with additional options of blinking lights or visual signals therefore encouraging its use;

d. is inexpensive, disposable in nature, easy to install, to replace, or to remove and thereby encouraging its use. Learning to lower the toilet lid after use is generally not a training process requiring a lengthy period of time; nor is it long-term when encouraging, teaching, and toilet training persons to use a toilet, as particularly small children.

It is generally not a lengthy period of time when an infant is at the developmental stage that a toilet lid position signal may be desirable for alerting others. Therefore, it may be desirable that a signal need not last the life of the toilet or lid. Being in proximity to body wastes, bacteria, and viruses encourages a low cost signaling device that is disposable in nature for hygienic reasons;

e. is an electronic toilet lid position signal that plays immediately and automatically upon being raised, and stops playing immediately and automatically upon being lowered which can be of convenience or comfort to users of the toilet and encourages such signals, particularly when the signal is entertaining, and can also be an incentive to use the toilet or to raise the seat;

f. is an electronic toilet lid position signal that is convenient or of comfort to users of the toilet and can also be a signaling means for persons needing assistance to notify others of the need to use the toilet;

g. is an electronic toilet lid position signal that doesn't require that the toilet have plumbing, flushing mechanisms, a toilet tank, a toilet bowl, or that the hinged lid be specifically a seat or a cover, or that the toilet be in proximity to an external power source;

h. does not require the use of tools, special equipment, or special skills for its installation;

i. does not require the use of external mechanical attachments such as handles, pedals, or elements manufactured into, or onto the toilet or lid to facilitate operation of the signal;

j. does not require the use of timers, thus requiring fewer steps in manufacture at less cost to the consumer;

k. is an electronic toilet lid position signal that utilizes commonly available housings, which may comprise recycled materials, thereby requiring fewer steps in manufacture at less cost to the consumer;

l. is an electronic toilet lid position signal that is capable of being easily produced in a variety of shapes, or displaying a variety of indicia, thereby encouraging its use;

m. is an electronic toilet lid position signal that utilizes common electrical circuits and electronic modules thereby requiring fewer steps in manufacture at less cost to the consumer;

n. is an electronic toilet lid position signal that utilizes an electrical circuit-closing position-sensing switch means made of commonly available materials, which may comprise recycled materials, and thereby requiring fewer steps in manufacture at less cost to the consumer;

o. is an electronic toilet lid position signal that requires the handling of only one component for installation.

Other objects and advantages of my invention are:

The electronic position signal device may serve purposes other than a toilet lid position signal.

The position signal device may be utilized as an audible and/or visual signal for entertainment, security, teaching, industrial, safety, or other purposes as an accessory on a lid or object, to signal that said lid or object has been raised to a vertical position; for example, being a lid of a music box, sewing box, fishing tackle box, jewelry box, garbage can, chest, tool box, diaper bag; or dolls, and other toys.

Further objects and advantages of the position signal device will become apparent from a consideration of the drawings and ensuing description.

DESCRIPTION OF DRAWINGS

Particular embodiments incorporating a gravity-actuated position signal device will be understood in conjunction with the accompanying drawings in which.

LIST OF REFERENCE NUMERALS

Figure 1A:
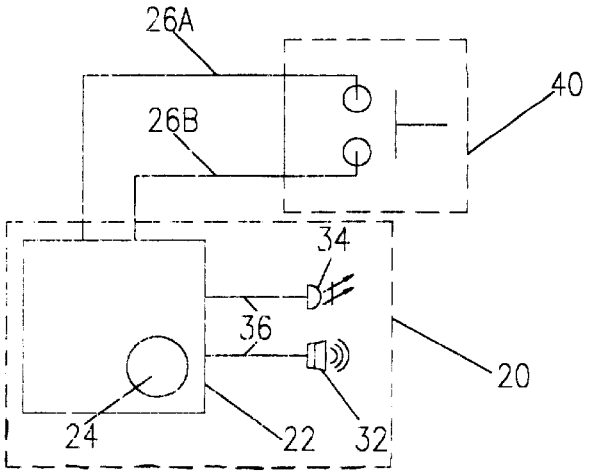
FIG. 1A is a block diagram depicting the components of the electronic position signal device.

10 Electronic position signal device
16 Indicia
20 Electronic signaling module
22 Electronic signaling module circuit board
24 Battery power source
26A Contact
26B Contact
28 Contact arm
30 Transducer
32 Loudspeaker
34 Light emitting diode (LED)
36 Electrical conductors
40 Position-sensitive switch
42 Open condition in circuit
44 Closed condition of circuit
50 Base
52 Housing
56A Attachment means of electronic module components to base or housing
56B Attachment means of weight means to delivery means
56C Attachment means of delivery means
56D Attachment means of base or housing to toilet lid
60 Weight means
70 Delivery means
80 Toilet lid
82 Toilet cover
84 Toilet seat
86 Hinge
90 Toilet
92 Void/Toilet bowl

DESCRIPTION OF INVENTION-FIGS. 1 TO 4

DESCRIPTION, FIGS. 1A–1C

FIG. 1A is a block diagram depicting the elements of the electronic position signal device.

The electronic position signal comprises a position-sensitive switch 40, and a self-powered electronic signaling module 20 which includes an electronic signaling module circuit board 22 on which is mounted battery power source 24, a transducer which may be a loudspeaker 32 and/or light emitting diode (LED) 34 electrically connected 36 to circuit board 22, contacts 26A and 26B, and means (not shown) for attaching the position signal to an object.

The self-powered electronic signaling module 20 is an item of commerce which is available from domestic and foreign vendors. Electronic signaling module 20 may be a music, sound, voice, and/or LED blinking light module of the common type commonly sold in the United States, Hong Kong, Taiwan, Japan, China, Thailand, and Philippines. In the preferred embodiment, a greeting card style electronic music, sound, and blinking light module is used. The module is commonly used in musical, voice-message, and blinking light greeting cards. An audio and/or visual signal may be stored in the module.

The transducer is a loudspeaker 32 when an audio signal is produced by the position signal device. The transducer is a light emitting diode 34 when a visual signal is produced by the position signal device. The transducer may be both a loudspeaker 32 and a light emitting diode 34 when both audio and visual signals are produced by the self-powered electronic signaling module 20.

The position-sensitive switch is depicted by circuit 40 within the dotted lines.

Position-sensitive switch 40 may be any one of a multitude of types. For example, it may be a gravity actuated mercury switch to indicate the position of an object in the vertical position. It may be a pressure sensitive switch to indicate that an object is positioned proximally to another object. It may be a magnetic proximity sensor to indicate that an object is positioned proximally to another object. It may be a conductive weight delivered by gravity to bridge a pair of open electrical contacts and indicate that an object has been moved from a vertical or horizontal position.

Figure 1B:
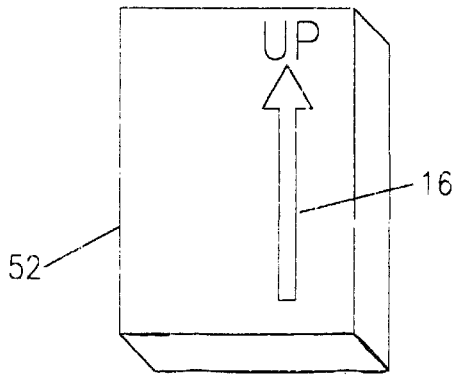
FIG. 1B is a perspective view of the housing of the position signal device showing indicia.

An embodiment of the electronic position signal device as a toilet lid position signal is illustrated in FIG. 1B.

FIG. 1B shows the electronic position signal device enclosed in a housing 52 with indicia 16.

Figure 1C:
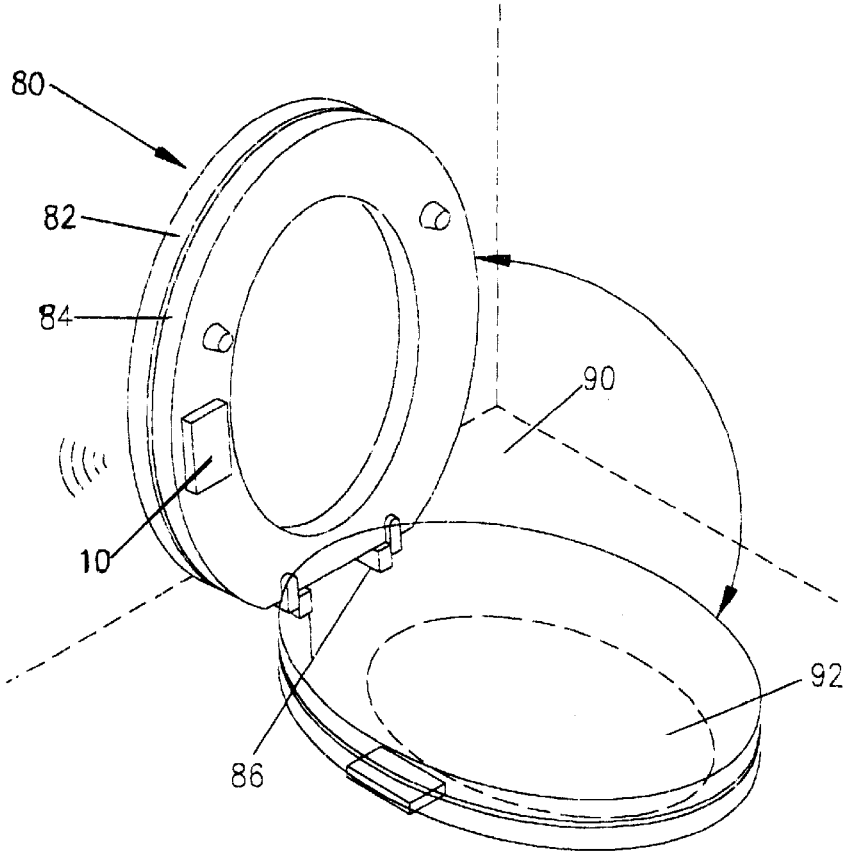
FIG. 1C is a perspective view of a toilet equipped with an embodiment of the position signal device of FIG 1B emplaced on a toilet lid in horizontal and vertical positions.

In the common toilet 90 construction shown in FIG. 1C, seat 84 is overlain by a hinged 86 cover 82 which is intended to be lowered after usage of the toilet to cover seat 84 and underlying void 92.

Referring to FIG. 1C, electronic toilet lid position signal 10 is emplaced on toilet lid 80 of the common type comprised of seat 84 and/or cover 82 which is attached to toilet 90 of the common type for producing an audible and/or visible signal when toilet lid 80 is in the upright position.

DESCRIPTION, FIGS. 2A–2B

Figure 2A:
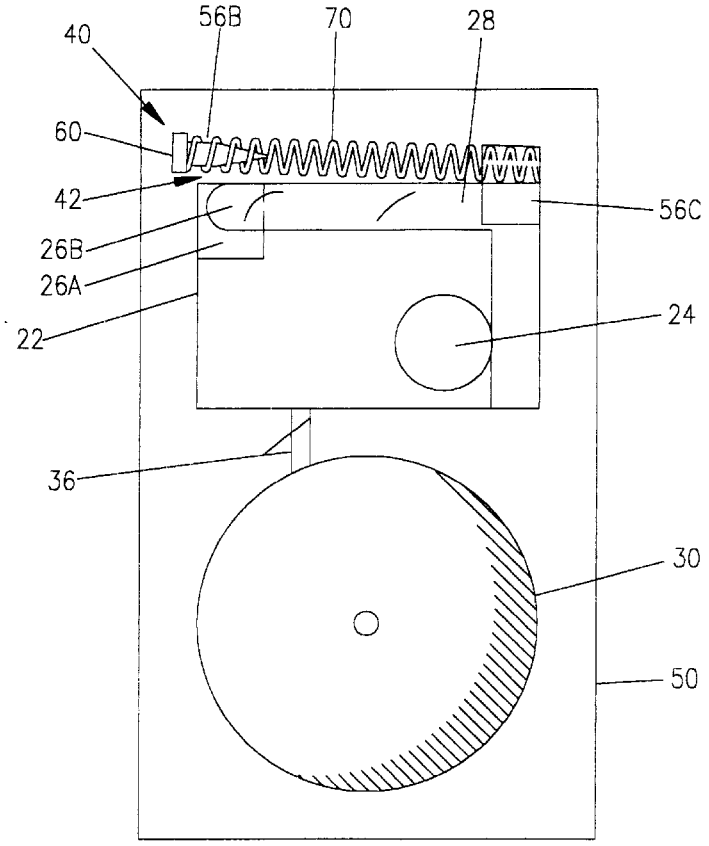
FIG 2A is a plan view of the position signal device in which the position-sensitive switch is open.

FIG. 2A is a plan view of the toilet lid position signal with components mounted on a base 50.

Figure 2B:
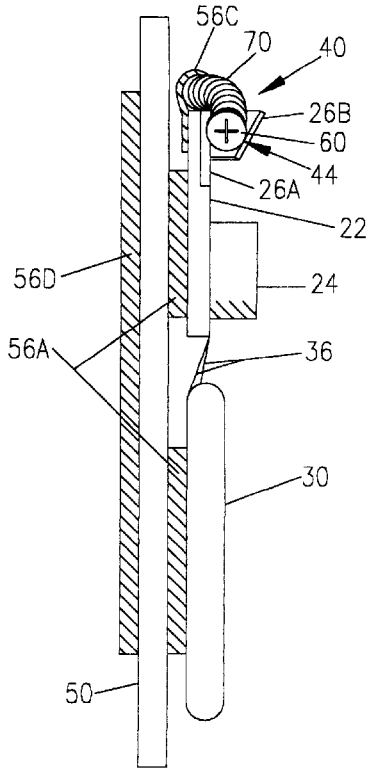
FIG 2B is a view of the position signal device of FIG. 2A as seen from the left side of the plan view in FIG. 2A in which the position-sensitive switch is closed.

The electronic signaling module components of circuit board 22 and transducer 30 are commonly provided with attachment means 56A, not shown in FIG. 2A, for attachment to a greeting card. Attachment means 56A means may be used for the attachment of said components to base 50, as shown in FIG. 2B.

Base 50 is formed of suitable material, the only requirements being that it be of relatively light weight, nonconductive, and of sufficient mechanical strength and size to support the transducer 30 and electronic signaling module circuit board 22 in proximity to position-sensitive switch 40 when the electronic toilet lid position signal is pivoted from a horizontal to a vertical position.

Base 50 in the preferred embodiment is made of commonly available plastic sheeting made of PVC or R-PET. However, the base could also be made of other common non-conductive material such as paper, cardboard, wood, or fiberboard for example.

Signaling module circuit board 22 commonly contains contacts 26A and 26B electrically connected to battery 24 as an electrical power source. Transducer 30 is connected to signaling module circuit board 22 by electrical conductors 36.

When circuit board 22 is used in a greeting card and the greeting card is closed, a thin electrical insulating material is inserted between contacts 26A and 26B opening the otherwise normally closed contacts. The insulating material is withdrawn from between contacts 26A and 26B when the greeting card is opened and the contacts close an electrical circuit that activates the electronic signaling module. The electronic signaling module is deactivated when closing the greeting card causes the reinsertion of the insulating material between contacts 26A and 26B.

Contacts 26A and 26B are normally closed in a greeting card style of electronic signaling module. Contact 26B is at the end of contact arm 28 which is commonly an integral part of circuit board 22. Contact arm 25 is bent to make contacts 26A and 26B open. A position-sensitive switch 40 electrically bridges the opened contacts 26A and 26B.

Position-sensitive switch 40 comprises a flexible, electrically-conductive cantilever support means 70, a weight 60 attached 56B to the unsupported end of cantilever support means 70, and a pair of open contacts 26A and 26B that are an integral part of electronic signaling module circuit board 22. The fixed end of cantilever 70 is mounted by means 56G to electronic signaling module circuit board 22.

FIG. 2B is a side view of the toilet lid position switch of FIG. 2A as seen from the left side of the plan view in FIG. 2A when the toilet lid position signal is in a vertical or a raised position. Under the influence of gravity, electrically conductive delivery means 70 bridges gap between contacts 26A and 26B thereby closing an electrical circuit 44 causing the toilet lid position signal to be activated.

The electronic signaling module circuit board 22 and transducer 30, are mounted on base 50 by attaching means 56A. Attaching means 56A may be adhesive tape of the common type however hook and loop closure tape, glue, etc. can be used for example.

Base 50 is provided with means 56D for attaching base 50 to the toilet lid at a location which facilitates closing of position-sensitive switch 40 when the toilet lid is raised to a vertical position. In this embodiment, the means 56D for attaching base 50, to an object is double-sided adhesive mounting tape of the common type. However, the attachment means may be any one of a multitude of types of materials, such as for example, hook and loop fastener, or glue.

In FIGS. 2A and 2B weight means 60 is formed of suitable material the only requirement being that the weight be of sufficient mechanical strength, size, conductivity, and weight to facilitate contact with contact regions 26A and 26B when electronic toilet lid position signal is in a vertical position.

Weight means 60 can be any suitable material of a common type such as a screw, nail, metal ball, solder bead, or split shot sinker for example. In the embodiment shown in FIGS. 2A and 2B, a #1 brass screw of the common type is utilized as a weight means 60.

Delivery means 70 can be any suitable conductive flexible material of a common type such as a compression spring, extension spring, coil spring, wire, or metal strip. In FIGS. 2A and 2B, an electrically conductive coiled wire spring of the common type is utilized as delivery means 70.

Weight means 60 is arranged and attached 56B to delivery means 70 as arranged and attached 56C to a location on circuit board 22 which enables delivery means 70 to be in proximity with contacts 26A and 26B and closes gap to complete circuit 44 when the toilet lid position signal is in a vertical position.

The preferred attaching means 56B of weight means 60 to delivery means 70 is insertion whereby screw 60 is inserted into the distal end of spring 70.

The preferred attaching means 56C of delivery means 70 to a location on electronic signaling module circuit board 22 is an adhesive of the common type where one end of spring 70 is attached to contact arm 28 and aligned with stationary contact region 26B of circuit board 22 with adhesive tape.

Raising the lid to a vertical position results in delivery means 70 bridging contacts 26A and 26B which closes the switch. This results in activation of the toilet lid position signal.

Position-sensitive switch 40 opens circuit 42 by delivery means 70 moving away from contacts 26A and Z6B when electronic toilet lid position signal is in a horizontal position. This causes the toilet lid position signal to be deactivated.

Thus switch 40 opens circuit 42 when electronic toilet lid position signal is in a horizontal position but closes circuit 44 to conduct current when electronic toilet lid position signal is in a vertical position.

Figure 3A:
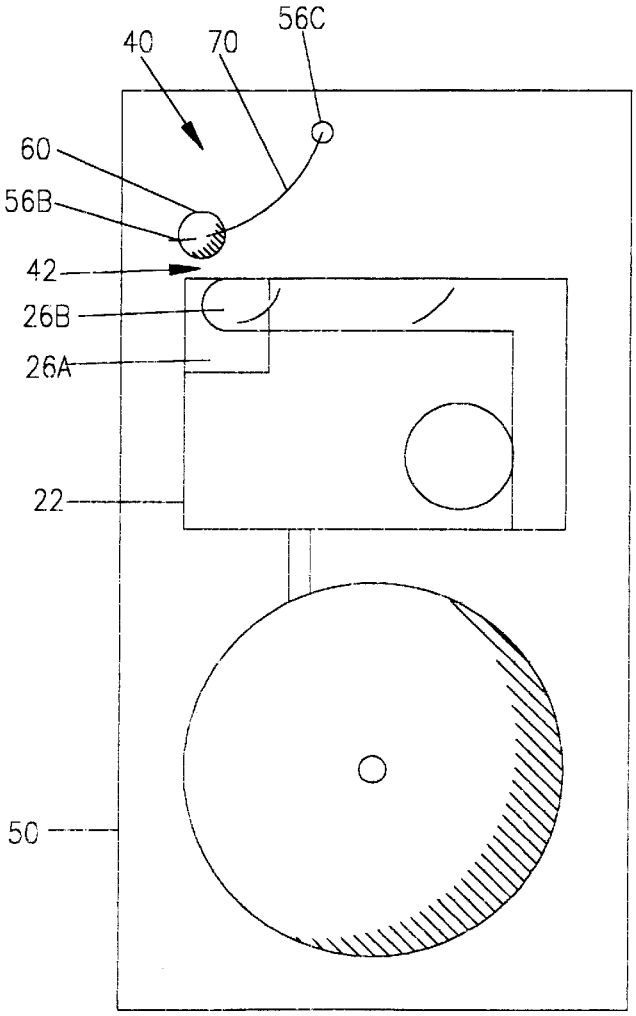
FIG. 3A is a plan view of the position signal device of FIG. 2A with a variation of the position-sensitive switch in which the position-sensitive switch is open.
Figure 3B:
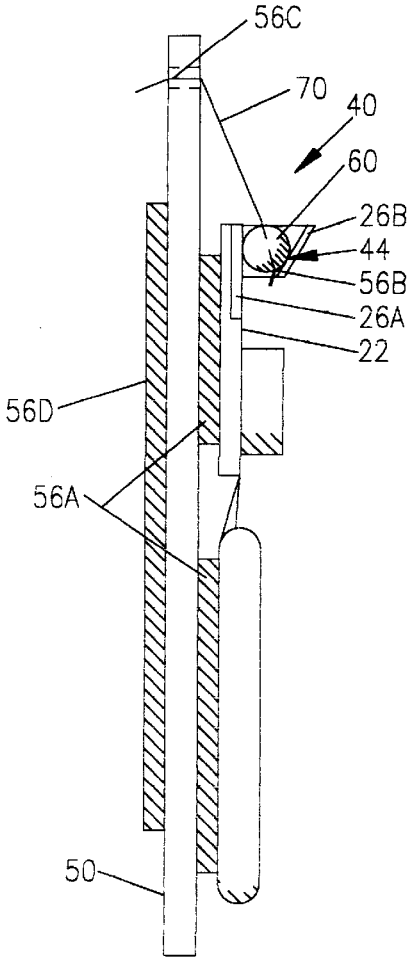
FIG. 3B is a view of the position signal device of FIG. 3A as seen from the left side of the plan view in FIG. 3A in which the position sensitive switch is closed.

DESCRIPTION, FIGS. 3A and 3B

FIGS. 3A and 3B are views of electronic toilet lid position signal of FIGS. 2A and 2B with a second embodiment of gravity-actuated position-sensitive switch 40.

FIG. 3A shows a plan view of the electronic toilet lid position signal with position-sensitive switch 40 in an open 42 circuit condition. Position-sensitive switch 40 has a pendulum structure comprising an electrically-conductive weight 60, a flexible means of support 70 to the free end of which weight 60 is attached, and a pair of open contacts 26A and 26B that are an integral part of electronic module circuit board 22. The fixed end of support means 70 is attached to base 50.

FIG. 3B is a left side view of FIG. 3A with position-sensitive switch 40 in a closed circuit condition.

Position-sensitive switch 40 is a pendulum type gravity-actuated switch comprising contacts 26A and 26B on electronic signaling module circuit board 22. The toilet lid position signal is activated when electrically-conductive weight means 60 on delivery means 70 bridges contacts 26A and 26B.

Electronic module circuit board 22 with contacts 26A and 26B is mounted 56A on base 50 in proximity to and in the path of movement of pendulum weight means 60 when electronic toilet lid position signal is in a vertical position.

As shown in FIG. 3B, switch 40 is in a closed condition 44 to conduct current between contacts 26A and 26B when electronic toilet lid position signal is in a vertical position causing weight means 60 to bridge contact regions 26A and 26B.

As shown in FIG. 3A, switch 40 is opened 42 by weight means 60 moving off contacts 26A and 26B when electronic toilet lid position signal is in a horizontal position.

Thus switch 40 is open when electronic toilet lid position signal is in a horizontal position when lid is down and is closed to conduct current 44 when electronic toilet lid position signal is in a vertical position when toilet lid is raised.

Weight means 60 is formed of any suitable material the only requirement being that the weight be of sufficient mechanical strength, size, conductivity, and weight to facilitate contact with contacts 26A and 26B when electronic toilet lid position signal is in a vertical position.

Weight means 60 can be made of any suitable material of the common type such as a screw, nail, metal ball, solder bead, or split shot sinker for example. In the preferred embodiment shown in FIGS. 3A and 3B, a size 3/0 split shot sinker of the common type is utilized as a conductive weight means 60.

Delivery means 70 is formed of any suitable material the only requirement being that the material be of relatively light weight, and be of sufficient mechanical strength, and size to support and deliver weight means 60 so as to facilitate contact with contacts 26A and 26B of circuit board 22 when electronic toilet lid position signal is in a vertical position.

Delivery means 70 can be any suitable flexible material of a common type such as a compression spring, extension spring, coil spring, plastic coil, elastic band, wire, or nylon filament for example. In the preferred embodiment shown in FIGS. 3A and 3B, a length of nylon filament of the common type is utilized as delivery means 70.

The preferred means 56B of attaching split shot sinker weight means 60 to nylon filament delivery means 70 is clamping whereby pinching clamps weight means 60 onto the distal end of delivery means 70.

Preferred means of attaching delivery means 70 to base 50 is by insertion whereby an end of nylon filament delivery means 70 is attached 56C to base 50 by being inserted into a slit or hole at a suitable location in base 50.

The points of attachment means 56B and 56C and length of delivery means 70 to base 50 are chosen to facilitate the bridging of stationary contacts 26A and 26B by split shot weight means 60 under the influence of gravity when the electronic position signal device is in an upright position.

Figure 4A:
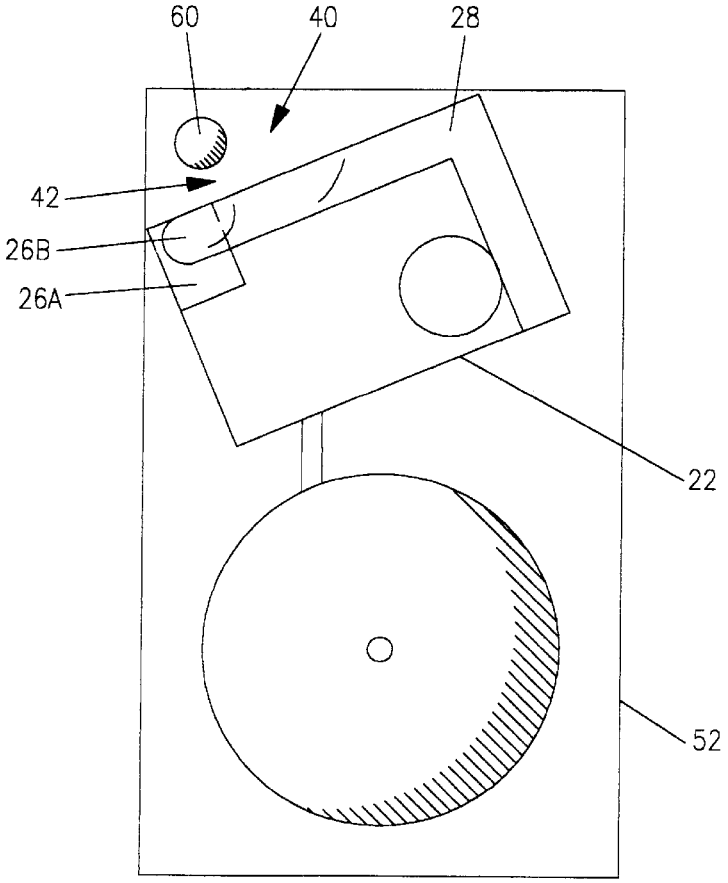
FIG. 4A is a plan view of the position signal device of FIG. 2A with another variation of the position-sensitive switch in which the position-sensitive switch is open.
Figure 4B:
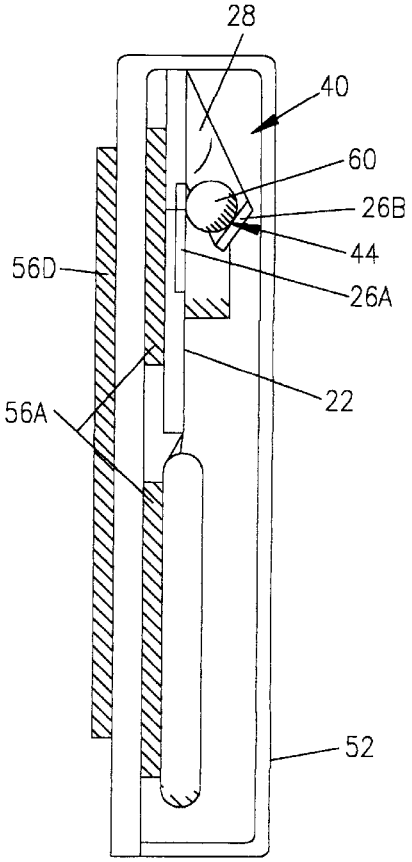
FIG. 4B is a view of the position signal device of FIG. 4A as seen from the left side of the plan view in FIG. 4A in which the position-sensitive switch is closed.

DESCRIPTION, FIGS. 4A and 4B

FIGS. 4A and 4B are views of electronic toilet lid position signal in FIGS. 2A and 2B with a third embodiment of gravity-actuated position-sensitive switch 40. The components of the electronic toilet lid position signal are contained and mounted in housing 52.

FIG. 4A is a plan view of toilet lid position switch with the alternative embodiment of the gravity-actuated position-sensitive switch 40 in an open circuit condition 42.

Position-sensitive switch 40 comprises a loose electrically-conductive weight 60 and a pair of open contacts 26A and 26B that are an integral part of electronic signaling module circuit board 22.

FIG. 4B is a left side view of FIG. 4A with position-sensitive switch 40 in a closed circuit condition 44.

Position-sensitive switch 40 comprises an enclosure cavity within housing 52, contacts 26A and 26B of which contact 26B is at the end of contact arm 28, electronic module circuit board 22, and a loose electrically-conductive weight means 60.

Loose electrically-conductive weight means 60 is blocked or restricted within housing 52 cavity by circuit board 22 with contacts 26A and 26B electrically isolated from housing 52.

Electronic signaling module circuit board 22 is arranged and mounted 56A at a slant within housing 52 so as to cause weight means 60 to move under the influence of gravity and towards contacts 26A and 26B when toilet lid position signal is in a vertical position. When weight means 60 is in proximity to contact 26B of contact arm 28, the shape of the enclosure within housing 52 constrains weight means 60 to close circuit 44 by bridging the gap between contact regions 26A and 26B thereby activating toilet lid position signal.

The enclosure cavity of housing 52 is shaped so to cause weight means 60 to move away from contacts 26A and 26B under the influence of gravity when toilet lid position signal is in a horizontal position opening condition in circuit 42 thereby deactivating electronic toilet lid position signal.

It will be understood by those knowledgeable in this art that the enclosure cavity of housing 52 may have other shapes including a cylinder, tube, groove, raceway, or channel, for enabling a freely moving conductive metal object, ball or BB to roll, slide or fall and bridge contacts 26A and 26B under the influence of gravity.

Housing 52 is formed of any suitable material, the only requirement being that housing 52 be of relatively light weight, easily formed, nonconductive, and be of sufficient mechanical strength and size to support electronic module circuit board 22 in proximity to and in the path of movement of weight means 60 when electronic toilet lid position signal is pivoted from a horizontal to a vertical position.

Housing 52 is a commonly available clam shell type blister packaging made of PVC or R-PET. However, it could also be made of other common non-conductive materials such as paper, cardboard, wood, or fiberboard for example.

Electronic signaling module circuit board 22 is fastened with attaching means 56A to one side of housing 52, housing 52 has means 56D for attaching housing 52 to the toilet lid at a location which facilitates closing of position-sensitive switch 40 when toilet lid is raised to a vertical position. In this embodiment, attaching means 56D is adhesive tape of the common type; however hook and loop closure tape, or glue, can be used for example.

Weight means 60 may be any electrically conductive object that is also of sufficient weight, size, and conductivity to bridge contacts 26A and 26B. In the preferred embodiment weight means 60 is a copper clad BB, however a mercury bead can be used for example.

It will be understood by those knowledgeable in this art that other circuit designs can be used to arrive at the same results without departing from the scope of the toilet lid position signal.

The manner of using an electronic toilet lid position signal 10 is simple. As shown in FIG. 1C, first put toilet lid 80 into an upright or vertical position and then attach electronic toilet lid position signal 10 onto toilet lid surface so that electronic signaling module produces an audible and/or visible signal. As shown in FIG. 1B, indicia 16 on a suitable surface of the electronic toilet lid position signal 10 may assist in suitable placement.

To remove electronic toilet lid position signal 10 from toilet lid 80, one simply pulls electronic toilet lid position signal 10 from the toilet lid surface.

To replace electronic toilet lid position signal 10, one simply arranges and attaches electronic toilet lid position signal 10 to the toilet lid surface.

Electronic toilet lid position signal 10 can be easily disposed of through common means when its battery is discharged.

Electronic toilet lid position signal 10 is a simple, reliable, inexpensive, entertaining device that signals users of a toilet that the lid is in an upright position.

While the above description contains many specificities, these should not be construed as limitations on the scope of the invention, but rather as exemplifications of some preferred embodiments thereof. Many other variations are possible.

For example, the embodiments of FIGS. 2, 3 and 4 may be emplaced within a housing with lights and/or indicia with complementary music, sounds or lights. For example, plays "Twinkle, Twinkle, Little Star" with blinking LED light arranged in predetermined strategic position within housing, which on the exterior of housing portrays a label with indicia and image of a child looking at stars in a night sky. Additional examples, LED lights may light up bowl area and toilet rim; bird-shaped housing with module making bird sounds, a "fisherman" model with line and sinker, "engineers" model with spring and screw, "electricians" model with solder bead on wire with switch mechanisms visible through housing.

Other objects and advantages of the position-sensitive switch are to activate other circuit boards or devices. The position-signal device may be utilized as an audible and/or visual signal for entertainment, security, teaching, industrial, safety, or other purposes; as attached on a lid or object to signal that said lid or object has been raised to a vertical position. For example, it may be emplaced in or on a lid of a: music box, sewing box, fishing tackle box, jewelry box, garbage can, chest, tool box, diaper bag; or with dolls and toys that play music or flash lights when picked up or tilted.

Conclusion, Ramifications, and Scope of Invention

The electronic toilet lid position signal is a highly reliable, lightweight, yet economical, signaling device that can be used by persons of any age.

Accordingly, additional advantages of the electronic toilet lid position signal are:

- it is a toilet lid position signaling accessory which includes an electronic audio and/or light module which is activated when a person raises a toilet lid and is deactivated when the lid is lowered;
- it is a device which is self-contained and can be of a size that can be utilized with any toilet comprising a hinged lid of the common type covering a void, said lid being capable of being moved between a vertical position and a horizontal position;
- it utilizes a low cost, commonly manufactured electronic signaling module providing a wide variety of options of entertaining melodies and/or other sounds with additional options of blinking lights or visual signals;
- it is a device that is inexpensive, disposable in nature, and easy to install, replace, and remove;
- it is a device that plays immediately and automatically when in a vertical position and stops playing immediately and automatically when in a horizontal position; can be of convenience or comfort to users of the toilet; and particularly, when the signal is entertaining, can be an incentive to use the toilet or to raise the seat;
- it is a device that can be a signaling means for persons needing assistance to notify others of the need to use the toilet;
- it is a device that doesn't require the toilet to have plumbing, flushing mechanisms, toilet tank, toilet bowl, or that the hinged lid be, specifically a seat or a cover, or that the toilet be in proximity to an external power source;
- it is a device that doesn't require the use of tools, special equipment, or special skills for its manufacture or installation;
- it is a device that doesn't require the utilization of external mechanical attachments such as handles, pedals, or the modification of toilets or lids to facilitate operation of the signal;
- it is a device that doesn't use timers, thus requiring fewer steps in manufacture at less cost to the consumer;
- it is a device that utilizes commonly available housings, which may comprise recycled materials at less cost to the consumer;
- it is a device that is capable of being easily produced in a variety of shapes which can display a variety of colorful labels or indicia;
- it is a device that does not utilize specialized electrical circuits which thereby requires fewer steps in manufacture at less cost to the consumer;
- It is a device that utilizes a switch made of commonly available materials, which may comprise recycled materials at less cost to the consumer;
- it is a device that requires the handling of only one component for installation.

While the electronic toilet lid position signal has been described with respect to a few preferred embodiments, many modifications and variations in the construction of the position-sensitive switch are possible and it is not intended to limit the electronic toilet lid position signal or position-sensitive switch except as defined in the following claims.

Accordingly, the scope of my invention should be determined not by the embodiments illustrated, but by the appended claims and their equivalents.

I claim:

1. An apparatus for indicating a toilet lid's position, comprising:

a housing for housing a position-sensitive switch and a self-powered electronic signaling module, which includes an electronic circuit board on which is mounted a battery power source and a pair of open contacts, and is connected to an audible and visible alarm means, wherein said audible and visible alarm means comprises a transducer and light emitting diodes;

said housing is mounted on the seat of the toilet lid;

said electronic signaling module activates the audible and visible alarms means when the toilet lid is in the upright position for reminding a user of returning the toilet lid to its lowered position after use;

wherein said position-sensitive switch includes a movable electrically-conductive object for bridging said pair open contacts;

wherein said moveable electrically-conductive object comprises a flexible electrically-conductive cantilever delivery means supported by being coupled to one end of said electronic signaling module and a weight means attached to the unsupported end of said cantilever delivery means whereby the unsupported end of said cantilever delivery means is deflected under the influence of gravity to move between said pair open contacts thereby closing an electrical circuit and activating said electronic position signal module.

* * * * *